US009660422B2

(12) United States Patent
Fukuzawa et al.

(10) Patent No.: US 9,660,422 B2
(45) Date of Patent: May 23, 2017

(54) SPARK PLUG FOR VOLTAGE RESISTANCE AND SUPPRESSION OF SIDE SPARKING AND OXIDATION

(71) Applicant: NGK SPARK PLUG CO., LTD., Nagoya-shi, Aichi (JP)

(72) Inventors: Reimon Fukuzawa, Iwakura (JP); Hiroaki Kuki, Nagoya (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 15/025,594

(22) PCT Filed: Jun. 15, 2015

(86) PCT No.: PCT/JP2015/002986
§ 371 (c)(1),
(2) Date: Mar. 29, 2016

(87) PCT Pub. No.: WO2015/198555
PCT Pub. Date: Dec. 30, 2015

(65) Prior Publication Data

US 2016/0233648 A1 Aug. 11, 2016

(30) Foreign Application Priority Data

Jun. 27, 2014 (JP) ..... 2014-132192

(51) Int. Cl.
*H01T 13/20* (2006.01)
*F02P 13/00* (2006.01)

(52) U.S. Cl.
CPC ..... *H01T 13/20* (2013.01); *F02P 13/00* (2013.01)

(58) Field of Classification Search
CPC ..... H01T 13/20; H01T 13/38; H01T 19/00; H01T 21/00; F02P 13/00
See application file for complete search history.

(56) References Cited

U.S. PATENT DOCUMENTS

2007/0126330 A1 6/2007 Kuki et al. ..... 313/143
2008/0093965 A1 4/2008 Takada et al. ..... 313/143
(Continued)

FOREIGN PATENT DOCUMENTS

CN 101874331 A 10/2010 ..... H01T 13/20
JP 2005-183177 A 7/2005 ..... H01T 13/16
(Continued)

OTHER PUBLICATIONS

International Search Report issued in corresponding International Patent Application No. PCT/JP2015/002986, dated Aug. 18, 2015.
(Continued)

*Primary Examiner* — Tracie Y Green
(74) *Attorney, Agent, or Firm* — Kusner & Jaffe

(57) ABSTRACT

A spark plug includes an insulator and a center electrode. The insulator includes: a first cylindrical portion; a truncated cone-shaped portion whose outer diameter reduces toward a front end side; and a second cylindrical portion formed at a front end side of the truncated cone-shaped portion. A diameter C of the center electrode is not larger than 2.2 mm. A total I of a volume of the truncated cone-shaped portion and a volume of the second cylindrical portion, a volume E of the center electrode from a position at a rear end of the truncated cone-shaped portion to a position at a front end of the second cylindrical portion, and the diameter C satisfy $I/E \geq 4.2333C^2 - 19.79C + 24.869$.

7 Claims, 9 Drawing Sheets

(56) References Cited

U.S. PATENT DOCUMENTS

| | | | | |
|---|---|---|---|---|
| 2010/0314987 | A1 | 12/2010 | Kyuno et al. | 313/130 |
| 2012/0161605 | A1* | 6/2012 | Ban | H01T 13/39<br>313/141 |

FOREIGN PATENT DOCUMENTS

| | | | | |
|---|---|---|---|---|
| JP | 2011-054418 | A | 3/2011 | F02P 13/00 |
| JP | 4970892 | B2 | 7/2012 | F02P 13/00 |

OTHER PUBLICATIONS

Office Action received in corresponding Chinese Patent Application No. 201580002454.5, dated Nov. 1, 2016.

* cited by examiner $\phi$C=1.7mm

| No. | MEASURED VALUE (mm) | | | | | CALCULATED VALUE | | | NOMINAL DIAMETER | GRADE |
|---|---|---|---|---|---|---|---|---|---|---|
| | $\phi$Z1 | $\Phi$Z2 | L | z1 | z2 | CERAMIC INSULATOR VOLUME I ($mm^3$) | CENTER ELECTRODE VOLUME E ($mm^3$) | VOLUME RATIO I/E | | |
| 1 | 6.9 | 3.3 | 12 | 2.0 | 3.0 | 149.9 | 22.4 | 6.69 | M14 | A |
| 2 | 6.9 | 3.3 | 12 | 2.8 | 3.0 | 134.8 | 20.6 | 6.55 | | |
| 3 | 6.9 | 3.7 | 12 | 2.8 | 5.5 | 120.5 | 20.6 | 5.86 | | |
| 4 | 6.9 | 3.7 | 15 | 2.8 | 7.5 | 157.4 | 27.4 | 5.75 | | |
| 5 | 6.9 | 3.3 | 12 | 2.8 | 5.5 | 103.0 | 20.6 | 5.01 | | |
| 6 | 6.9 | 3.7 | 12 | 2.8 | 7.5 | 96.5 | 20.6 | 4.69 | | |
| 7 | 6.9 | 3.7 | 12 | 2.8 | 8.0 | 90.5 | 20.6 | 4.40 | | |
| 8 | 6.9 | 3.7 | 9 | 2.8 | 5.5 | 59.6 | 13.8 | 4.33 | | |
| 9 | 5.7 | 3.2 | 12 | 2.8 | 5.5 | 80.5 | 20.6 | 3.91 | M12 | |
| 10 | 5.1 | 3.2 | 15 | 2.8 | 5.5 | 106.4 | 27.4 | 3.88 | M10 | |
| 11 | 6.9 | 3.7 | 12 | 2.8 | 9.0 | 78.6 | 20.6 | 3.82 | M14 | |
| 12 | 6.9 | 3.3 | 12 | 2.8 | 7.5 | 77.6 | 20.6 | 3.77 | | B |
| 13 | 6.9 | 3.3 | 12 | 2.8 | 8.0 | 71.2 | 20.6 | 3.46 | | |
| 14 | 6.9 | 3.3 | 12 | 2.8 | 9.0 | 58.5 | 20.6 | 2.84 | | X |

FIG. 4

$\phi$C=1.9mm

| No. | MEASURED VALUE (mm) | | | | | CALCULATED VALUE | | | NOMINAL DIAMETER | GRADE |
|---|---|---|---|---|---|---|---|---|---|---|
| | $\phi$Z1 | ΦZ2 | L | z1 | z2 | CERAMIC INSULATOR VOLUME I ($mm^3$) | CENTER ELECTRODE VOLUME E ($mm^3$) | VOLUME RATIO I/E | | |
| 15 | 6.9 | 3.3 | 12 | 2.0 | 3.0 | 144.0 | 28.0 | 5.14 | M14 | A |
| 16 | 6.9 | 3.3 | 12 | 2.8 | 3.0 | 129.4 | 25.8 | 5.02 | | |
| 17 | 6.9 | 3.7 | 12 | 2.8 | 5.5 | 115.1 | 25.8 | 4.47 | | |
| 18 | 6.9 | 3.7 | 15 | 2.8 | 7.5 | 150.3 | 34.3 | 4.38 | | |
| 19 | 6.9 | 3.3 | 12 | 2.8 | 5.5 | 97.6 | 25.8 | 3.79 | | |
| 20 | 6.9 | 3.7 | 12 | 2.8 | 7.5 | 91.1 | 25.8 | 3.54 | | |
| 21 | 6.9 | 3.7 | 12 | 2.8 | 8.0 | 85.2 | 25.8 | 3.30 | | |
| 22 | 6.9 | 3.7 | 9 | 2.8 | 5.5 | 56.0 | 17.3 | 3.24 | | |
| 23 | 5.7 | 3.4 | 12 | 2.8 | 5.5 | 83.2 | 25.8 | 3.23 | M12 | |
| 24 | 5.1 | 3.4 | 15 | 2.8 | 5.5 | 109.1 | 34.3 | 3.18 | M10 | |
| 25 | 4.7 | 3.4 | 15 | 2.8 | 5.5 | 99.8 | 34.3 | 2.91 | | |
| 26 | 6.9 | 3.7 | 12 | 2.8 | 9.0 | 73.2 | 25.8 | 2.84 | M14 | |
| 27 | 6.9 | 3.3 | 12 | 2.8 | 7.5 | 72.2 | 25.8 | 2.80 | | |
| 28 | 6.9 | 3.3 | 12 | 2.8 | 8.0 | 65.8 | 25.8 | 2.55 | | B |
| 29 | 6.9 | 3.3 | 12 | 2.8 | 9.0 | 53.1 | 25.8 | 2.06 | | X |

FIG. 5

$\phi$C=2.2mm

| No. | MEASURED VALUE (mm) | | | | | CALCULATED VALUE | | | NOMINAL DIAMETER | GRADE |
|---|---|---|---|---|---|---|---|---|---|---|
| | $\phi$Z1 | $\Phi$Z2 | L | z1 | z2 | CERAMIC INSULATOR VOLUME I ($mm^3$) | CENTER ELECTRODE VOLUME E ($mm^3$) | VOLUME RATIO I/E | | |
| 30 | 6.9 | 3.3 | 12 | 2.0 | 3.0 | 134.1 | 37.7 | 3.56 | M14 | A |
| 31 | 6.9 | 3.3 | 12 | 2.8 | 3.0 | 120.3 | 34.7 | 3.47 | | |
| 32 | 6.9 | 3.7 | 12 | 2.8 | 5.5 | 106.0 | 34.7 | 3.06 | | |
| 33 | 6.9 | 3.7 | 15 | 2.8 | 7.5 | 138.2 | 46.1 | 3.00 | | |
| 34 | 6.9 | 3.3 | 12 | 2.8 | 5.5 | 88.5 | 34.7 | 2.55 | | |
| 35 | 5.7 | 3.7 | 12 | 2.8 | 5.5 | 87.0 | 34.7 | 2.51 | M12 | |
| 36 | 5.1 | 3.7 | 15 | 2.8 | 5.5 | 112.6 | 46.1 | 2.44 | M10 | |
| 37 | 6.9 | 3.7 | 12 | 2.8 | 7.5 | 82.0 | 34.7 | 2.37 | M14 | |
| 38 | 4.7 | 3.7 | 15 | 2.8 | 5.5 | 103.1 | 46.1 | 2.24 | M10 | |
| 39 | 6.9 | 3.7 | 12 | 2.8 | 8.0 | 76.0 | 34.7 | 2.19 | M14 | |
| 40 | 6.9 | 3.7 | 9 | 2.8 | 5.5 | 49.8 | 23.3 | 2.14 | | B |
| 41 | 6.9 | 3.7 | 12 | 2.8 | 9.0 | 64.0 | 34.7 | 1.85 | | |
| 42 | 6.9 | 3.3 | 12 | 2.8 | 7.5 | 63.0 | 34.7 | 1.82 | | |
| 43 | 6.9 | 3.3 | 12 | 2.8 | 8.0 | 56.7 | 34.7 | 1.63 | | X |
| 44 | 6.9 | 3.3 | 12 | 2.8 | 9.0 | 43.9 | 34.7 | 1.27 | | |

FIG. 6

| No. | g(mm) | ANTI-FOULING CHARACTERISTIC |
|---|---|---|
| 45 | 4 | A |
| 46 | 2.5 | A |
| 47 | 1.5 | A |
| 48 | 1 | B |
| 49 | 0.5 | B |

| No. | z2(mm) | R2(mm) | AREA S ($mm^2$) | BREAKAGE RESISTANCE |
|---|---|---|---|---|
| 50 | 4 | 10 | 0.11 | A |
| 51 | 4 | 4.5 | 0.02 | A |
| 52 | 4 | 3.5 | 0.01 | B |
| 53 | 4 | 0 | 0 | B |
| 54 | 3 | 0 | 0 | A |
| 55 | 2 | 0 | 0 | A |

| No. | ENGINE | | FIRST CIRCULAR-COLUMN PORTION | t | SECOND CIRCULAR-COLUMN PORTION | φz2 (mm) | φC (mm) | EVALUATION |
|---|---|---|---|---|---|---|---|---|
| | INTAKE | COMPRESSION RATIO | | | | | | |
| 56 | NA | 11 | PRESENT | POSITIVE | PRESENT | 3.7 | 2.2 | A |
| 57 | NA | 11 | PRESENT | NEGATIVE | PRESENT | 3.7 | 2.2 | X |
| 58 | NA | 11 | ABSENT | – | ABSENT | 5.1 | 2.6 | X |
| 59 | NA | 10 | ABSENT | – | ABSENT | 5.1 | 2.6 | A |
| 60 | NA | 9 | ABSENT | – | ABSENT | 5.1 | 2.6 | A |
| 61 | S | 9.5 | PRESENT | POSITIVE | PRESENT | 3.7 | 2.2 | A |
| 62 | S | 9.5 | PRESENT | NEGATIVE | PRESENT | 3.7 | 2.2 | X |
| 63 | S | 9.5 | ABSENT | – | ABSENT | 5.1 | 2.6 | X |
| 64 | S | 7 | ABSENT | – | ABSENT | 5.1 | 2.6 | A |
| 65 | S | 6 | ABSENT | – | ABSENT | 5.1 | 2.6 | A |

FIG. 10

SPARK PLUG FOR VOLTAGE RESISTANCE AND SUPPRESSION OF SIDE SPARKING AND OXIDATION

FIELD OF THE INVENTION

The present invention relates to a spark plug.

BACKGROUND OF THE INVENTION

A general spark plug includes a metal shell, a center electrode, and an insulator. Known shapes of the insulator include one that has, sequentially from a rear end side, a first cylindrical portion, a truncated cone-shaped portion, and a second cylindrical portion whose outer diameter is smaller than that of the first cylindrical portion. The first cylindrical portion is a cylindrical part formed inside the metal shell. The truncated cone-shaped portion is a part that is formed on a front end side of the first cylindrical portion and whose outer diameter becomes smaller toward the front end side. The second cylindrical portion is a part that is formed on the front end side of the truncated cone-shaped portion and whose at least one portion projects out from a front end surface of the metal shell. The first cylindrical portion, the truncated cone-shaped portion, and the second cylindrical portion are all hollow, and a center electrode is disposed in the hallow space (e.g., Japanese Patent Application Laid-Open (kokai) No. 2005-183177).

On the other hand, in recent years, there is a trend to increase the compression ratio of an engine, and the voltage (required voltage) for discharging at a regular discharge position (gap) has been increased in a spark plug. When the required voltage is high, voltage resistance is demanded strictly, and side sparking (discharge between the insulator and the metal shell) occurs easily. Side sparking occurs easily particularly around the front end surface of the metal shell.

Reducing the diameter of the center electrode is effective for improving anti-side sparking characteristic and voltage resistance without increasing the overall size of the spark plug. However, since the heat capacity of the center electrode becomes smaller when the diameter of the center electrode becomes smaller, the temperature of the center electrode rises easily, and oxidation of the center electrode is accelerated. Thus, reducing the diameter of the center electrode has been conventionally difficult.

Another method for suppressing side sparking is to radially separate, at around the front end surface of the metal shell, the outer circumference of the insulator from the inner circumference of the metal shell as much as possible. With this method, reducing the outer diameter of the insulator can be achieved.

However, an attempt to ensure certain thickness of the insulator while reducing the outer diameter of the insulator results in thinning of the center electrode disposed inside the insulator and causes the above described problem. On the other hand, when the insulator is thinned, the heat capacity of the insulator reduces, and the temperature of the center electrode easily rises. As a result, oxidation of the center electrode is accelerated.

Since the above described dilemma has existed conventionally, simultaneously achieving improvement in voltage resistance, suppression of oxidation of the center electrode, and suppression of side sparking has been difficult.

The present invention is intended to solve the above described problem, and can be embodied in the following modes.

SUMMARY OF THE INVENTION (1) According to one mode of the present invention, a spark plug is provided and includes: an insulator having an axial hole that extends along an axis line; a center electrode inserted within the axial hole; a metal shell disposed at an outer circumference of the insulator and having an inner circumference having formed thereon a shelf portion that bulges radially inward; and a ground electrode disposed at a front end of the metal shell. The insulator includes: a first cylindrical portion formed at a position that opposes at least a part of the shelf portion; a truncated cone-shaped portion that is formed at a front end side of the first cylindrical portion and whose outer diameter reduces toward the front end side; a second cylindrical portion formed at a front end side of the truncated cone-shaped portion. In the spark plug: a diameter C of the center electrode at a position opposing the shelf portion in a direction along the axis line is not larger than 2.2 mm; and a total I of a volume of the truncated cone-shaped portion and a volume of the second cylindrical portion, a volume E of the center electrode from a position at a rear end of the truncated cone-shaped portion to a position at a front end of the second cylindrical portion with respect to the direction along the axis line, and the diameter C, satisfy $I/E \geq 4.2333C^2 - 19.79C + 24.869$.

With the above described mode, improvement in voltage resistance, suppression of side sparking, and suppression of oxidation of the center electrode can be achieved simultaneously. The voltage resistance improves because certain thickness of the first cylindrical portion can be ensured easily since the diameter of the center electrode is small (not larger than 2.2 mm). Side sparking and oxidation of the center electrode are suppressed since I/E described above is set within an appropriate range. More specifically, in a case where the diameter of the center electrode is small, by appropriately setting I/E described above, an appropriate balance is obtained between the distance from the metal shell to the insulator and the heat capacity of the insulator, and side sparking and oxidation of the center electrode are suppressed.

(2) In accordance with a second aspect of the present invention, there is provided a spark plug according to the above mode, wherein the total I, the volume E, and the diameter C may satisfy the following formula: $I/E \geq 6.1333C^2 - 27.18C + 32.301$. According to this mode, oxidation of the center electrode is further suppressed.

(3) In accordance with a third aspect of the present invention, there is provided a spark plug according to the above mode, wherein a position at, with respect to the direction along the axis line, a front end of the first cylindrical portion may be located on the front end side with respect to a position at, with respect to the direction along the axis line, a front end of a surface of the shelf portion opposing the first cylindrical portion. According to this mode, voltage resistance of the insulator improves at the front end position of the opposing surface. This is because the position of the opposing surface and the position of the truncated cone-shaped portion are misaligned in the direction along the axis line, and certain thickness can be ensured for the insulator at the position opposing the opposing surface.

(4) In accordance with a fourth aspect of the present invention, there is provided a spark plug according to the above mode, wherein a position at, with respect to the direction along the axis line, a rear end of the second cylindrical portion may be located toward the rear end side by a distance not smaller than 1.5 mm from a position of a front end surface of the metal shell. According to this mode, side sparking is further suppressed. In this mode, the boundary between the second cylindrical portion and the truncated cone-shaped portion is located toward the rear end side by a distance not smaller than 1.5 mm from the position of the front end surface of the metal shell. Since fouling of the insulator associated with combustion within a combustion chamber occurs more easily when the outer diameter of the insulator is larger, fouling occurs more easily near the boundary or toward the rear end side from the boundary. Side sparking is induced at a part where fouling has occurred. Thus, as in this mode, side sparking is further suppressed by separating, by a distance not smaller than 1.5 mm, the part where fouling occurs easily and the front end surface of the metal shell where, by nature, side sparking occurs easily.

(5) In accordance with a fifth aspect of the present invention, there is provided a spark plug according to the above mode, wherein a length of the second cylindrical portion in the direction along the axis line may be not smaller than 4 mm, and an area, in a cross section including the axis line, of one side of a padded part surrounded by a straight line at a front end side of the truncated cone-shaped portion, a straight line extended from the second cylindrical portion, and an outer diameter line of the insulator, may be 0.02 $mm^2$. According to this mode, breakage of the insulator is suppressed even when the second cylindrical portion is long (not smaller than 4 mm). A phenomenon of high pressure being generated in a combustion chamber is known when an engine with a high compression ratio is used. When such a high pressure is generated, a large force is applied on the second cylindrical portion, and breakage easily occurs at the boundary between the second cylindrical portion and the truncated cone-shaped portion. Thus, the breakage occurs more easily when the second cylindrical portion is longer. By forming the padded part having a cross-sectional area as in this mode, the boundary is reinforced and the above described advantageous effect can be obtained.

(6) In accordance with a sixth aspect of the present invention, there is provided a spark plug according to the above mode, wherein an external thread may be formed on an outer circumference of the metal shell, and a nominal diameter of the external thread may be M14. According to this mode, oxidation of the center electrode can be suppressed even with a strict condition for oxidation of the center electrode such as the nominal diameter of the external thread being M14. When the diameter of the center electrode is small and the nominal diameter of the external thread is M14, the volume of the space between the outer circumference of the insulator and the inner circumference of the metal shell becomes large. When the volume of this space becomes large, the heat capacity of gas within the space becomes large. As a result, the temperature of the center electrode rises easily, leading to acceleration of oxidation of the center electrode. However, with this mode, since I/E described above is set appropriately, oxidation of the center electrode can be suppressed.

(7) In accordance with a seventh aspect of the present invention, there is provided a spark plug according to the above mode, wherein the spark plug may be used in at least one of an engine with a supercharger and having a compression ratio of not lower than 9.5, or a natural air intake engine having a compression ratio of not lower than 11. According to this mode, the above described advantageous effect can be obtained when the spark plug is used in any one of an engine with a supercharger and having a compression ratio of not lower than 9.5, and a natural air intake engine having a compression ratio of not lower than 11.

The present invention can be implemented in various modes other than a device. For example, the present invention can be implemented in modes such as a method for manufacturing a spark plug.

BRIEF DESCRIPTION OF THE DRAWINGS

FIG. 4 is a table showing an evaluation test of center electrodes (when the center electrodes have a diameter of 1.7 mm).

FIG. 5 is a table showing an evaluation test of center electrodes (when the center electrodes have a diameter of 1.9 mm).

FIG. 6 is a table showing an evaluation test of center electrodes (when the center electrodes have a diameter of 2.2 mm).

FIG. 10 is a table showing test results of insulation characteristic.

DETAILED DESCRIPTION OF THE PREFERRED EMBODIMENTS

Figure 1:
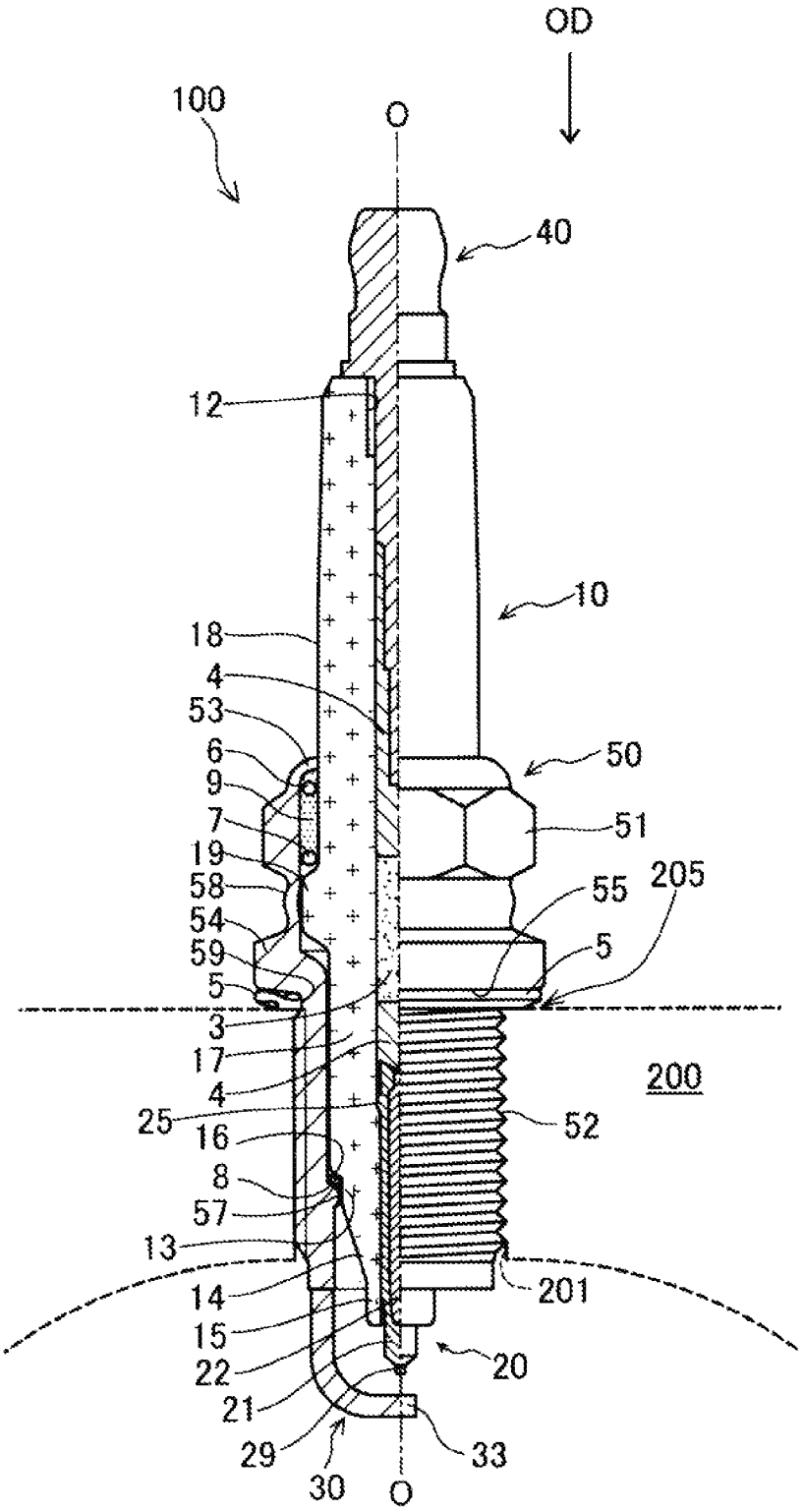
FIG. 1 is a partial cross-sectional view showing a spark plug.

FIG. 1 is a partial cross-sectional view showing a spark plug 100. In the following, an axis line direction OD shown in FIG. 1 is defined as up-down direction in the drawing, and the lower side is defined as the front end side of the spark plug and the upper side is defined as the rear end side of the spark plug in the description. In FIG. 1, the exterior view of the spark plug 100 is shown on the right side of an axis line O, and a cross section of the spark plug 100 is shown on the left side of the axis line O.

The spark plug 100 is a device that is to be attached to an engine head 200 of a gasoline engine, and ignites an air-fuel mixture within a combustion chamber by causing spark discharge between electrodes at the front end.

The spark plug 100 includes a ceramic insulator 10, a center electrode 20, a ground electrode 30, a metal terminal 40, and a metal shell 50. The ceramic insulator 10 is a member that functions as an insulator, and has an axial hole 12 that extends along the axis line O. The center electrode 20 is a bar-shaped electrode that extends along the axis line O, and is retained in a state of being inserted within the axial hole 12 of the ceramic insulator 10. The metal shell 50 is a tubular member that surrounds the outer circumference of the ceramic insulator 10, and has the ceramic insulator 10 fixed inside.

The ground electrode 30 is an electrode having one end fixed on the front end of the metal shell 50 and another end opposing the center electrode 20. The metal terminal 40 is a terminal to be supplied with power, and is electrically connected to the center electrode 20. When high voltage is applied between the metal terminal 40 and the engine head 200 in a state where the spark plug 100 is attached to the engine head 200, spark discharge occurs between the center electrode 20 and the ground electrode 30. In the following, details of each member will be described.

The ceramic insulator 10 is a tubular insulator formed of ceramic, and has formed therein the axial hole 12 extending in the axis line direction OD along the axis line O. In the present embodiment, the ceramic insulator 10 is formed by sintering alumina. At the approximate center of the ceramic insulator 10 in the axis line direction OD, a flange 19 whose outer diameter is the largest is formed; and on the rear end side of the flange 19, a rear end-side trunk portion 18 is formed. On the front end side of the flange 19, a front end-side trunk portion 17 whose outer diameter is smaller than that of the rear end-side trunk portion 18 is formed. Further on the front end side of the front end-side trunk portion 17, a first cylindrical portion 13, a truncated cone-shaped portion 14, and a second cylindrical portion 15 are formed. The outer diameter of the truncated cone-shaped portion 14 becomes smaller toward the front end side. In the state where the spark plug 100 is attached to the engine head 200, the truncated cone-shaped portion 14 and the second cylindrical portion 15 are exposed to gas within the combustion chamber. An outer circumference-side step portion 16 is formed between the first cylindrical portion 13 and the front end-side trunk portion 17.

The center electrode 20 is a bar-shaped member disposed within the axial hole 12 of the ceramic insulator 10 and extending from the rear end side to the front end side. The front end of the center electrode 20 is exposed at the front end side of the ceramic insulator 10. An electrode tip 29 is provided on the front end of the center electrode 20. The electrode tip 29 is formed of a platinum alloy, an iridium alloy, or the like, and is bound to the front end of an electrode base material 21 through welding. The center electrode 20 includes a center electrode flange portion 25 that protrudes radially.

The center electrode 20 has a structure in which a core material 22 is embedded inside the electrode base material 21. The electrode base material 21 is formed of a nickel alloy such as INCONEL 600 (INCONEL is a registered trademark). The core material 22 is formed of a metal having a higher coefficient of thermal conductivity than the electrode base material 21. Specifically, the core material 22 is formed of copper or an alloy mainly composed of copper.

A seal body 4 and a ceramic resistor 3 are disposed within the axial hole 12 of the ceramic insulator 10 and on the rear end side of the center electrode 20. The center electrode 20 is electrically connected to the metal terminal 40 via the seal body 4 and the ceramic resistor 3.

The metal shell 50 is a tubular metal shell formed of a low-carbon-steel material, and retains therein the ceramic insulator 10. Examples of the low-carbon-steel material include S17C and S25C. A part ranging from one part of the rear end-side trunk portion 18 of the ceramic insulator 10 to one part of the second cylindrical portion 15 is surrounded by the metal shell 50.

A tool engagement portion 51 and a thread portion 52 are formed on the outer circumference of the metal shell 50. The tool engagement portion 51 is a part that engages a spark plug wrench (not shown). The thread portion 52 of the metal shell 50 is a part where thread ridges are formed and is screwed together with an attachment thread hole 201 of the engine head 200. The spark plug 100 is fixed in the engine head 200 when the thread portion 52 of the metal shell 50 is screwed together with and fastened to the attachment thread hole 201 of the engine head 200. The nominal diameter of the thread portion 52 in the present embodiment is M14.

A flange 54 that has a flange-like shape and that projects radially outward is formed between the tool engagement portion 51 and the thread portion 52 of the metal shell 50. An annular gasket 5 is fitted on a thread root 59 between the thread portion 52 and the flange 54. The gasket 5 is formed by bending a plate body, and, when the spark plug 100 is attached to the engine head 200, is crushed and deforms between a seating surface 55 of the flange 54 and an opening peripheral portion 205 of the attachment thread hole 201. When the gasket 5 deforms, clearance between the spark plug 100 and the engine head 200 is sealed, and leakage of combustion gas through the attachment thread hole 201 is suppressed.

A thin crimp portion 53 is formed on the rear end side of the tool engagement portion 51 of the metal shell 50. A thin buckling portion 58 is formed between the flange 54 and the tool engagement portion 51. Toric ring members 6 and 7 are inserted between the inner circumferential surface of the metal shell 50 from the tool engagement portion 51 to the crimp portion 53, and the outer circumferential surface of the rear end-side trunk portion 18 of the ceramic insulator 10. Powder of a talc 9 is loaded between the two ring members 6 and 7. In the manufacturing process of the spark plug 100, when the crimp portion 53 is bent inwards and is crimped, the buckling portion 58 deforms in a buckling manner outward associated with application of compressive force, and the metal shell 50 and the ceramic insulator 10 become fixed. The talc 9 is compressed during a crimping step to increase airtightness between the metal shell 50 and the ceramic insulator 10.

The ground electrode 30 shown in FIG. 1 is an electrode connected with the front end of the metal shell 50, and is preferably formed of an alloy having excellent corrosion resistance. The ground electrode 30 in the present embodiment is formed from nickel or an alloy mainly composed of nickel (e.g., INCONEL 600, INCONEL 601, etc.). Connecting of the ground electrode 30 and the metal shell 50 is achieved by, for example, welding. A front end portion 33 of the ground electrode 30 opposes the front end of the center electrode 20.

A high voltage cable (not shown) is connected to the metal terminal 40 via a plug cap (not shown). As previously mentioned, when high voltage is applied between the metal terminal 40 and the engine head 200, spark discharge occurs between the ground electrode 30 and the center electrode 20.

Figure 2:
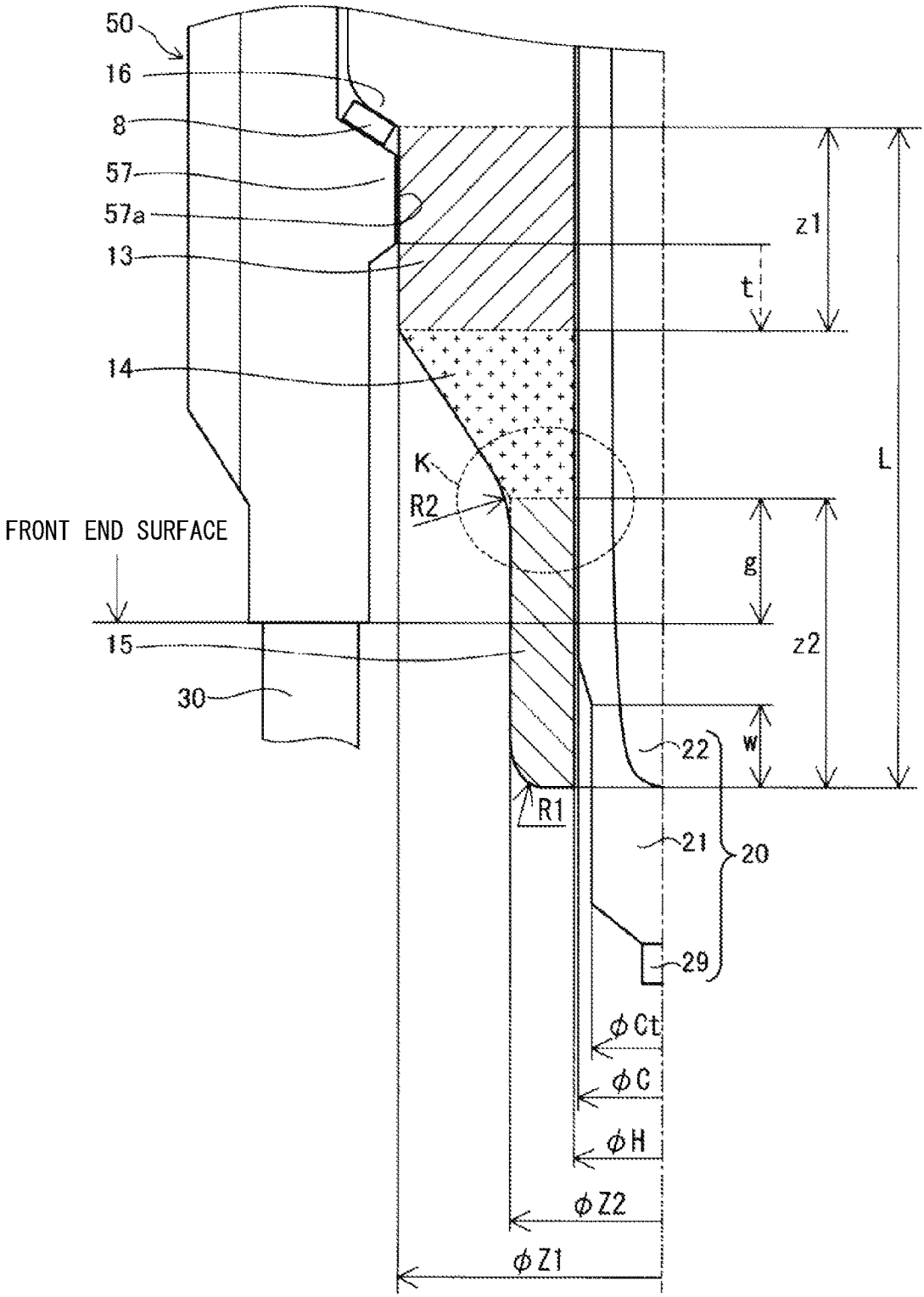
FIG. 2 is a cross-sectional view around the front end of the spark plug.

FIG. 2 shows a cross section around the front end of the spark plug 100 in an enlarged manner. A shelf portion 57 that protrudes radially inward is formed on the inner circumference of the metal shell 50. An annular plate packing 8 is provided between the shelf portion 57 and the outer circumference-side step portion 16 of the ceramic insulator 10. Airtightness between the metal shell 50 and the ceramic insulator 10 is ensured also by the plate packing 8 and leakage of combustion gas is suppressed.

As shown in FIG. 2, the ceramic insulator 10 includes the first cylindrical portion 13, the truncated cone-shaped portion 14, and the second cylindrical portion 15. The first cylindrical portion 13 is a part disposed at a position opposing at least a part of the shelf portion 57. The first cylindrical portion 13 in the present embodiment opposes the entirety of the shelf portion 57. The truncated cone-shaped portion 14 is formed on the front end side of the first cylindrical portion 13. The second cylindrical portion 15 is formed on the front end side of the truncated cone-shaped portion 14. The first cylindrical portion 13, the truncated cone-shaped portion 14, and the second cylindrical portion 15 are integrally formed together with other parts of the ceramic insulator 10.

The first cylindrical portion 13 and the second cylindrical portion 15 have a hollow cylindrical shape, i.e., a cylindrical shape. The truncated cone-shaped portion 14 has a hollow truncated cone shape. The outer diameter of the second cylindrical portion 15 is smaller than the outer diameter of the first cylindrical portion 13. The outer diameter of the truncated cone-shaped portion 14 becomes smaller toward the front end side. As shown in FIG. 2 as R1, the front end of the second cylindrical portion 15 has a rounded shape. Thus, a rounded shape is formed at the front end of the second cylindrical portion 15.

Figure 3:
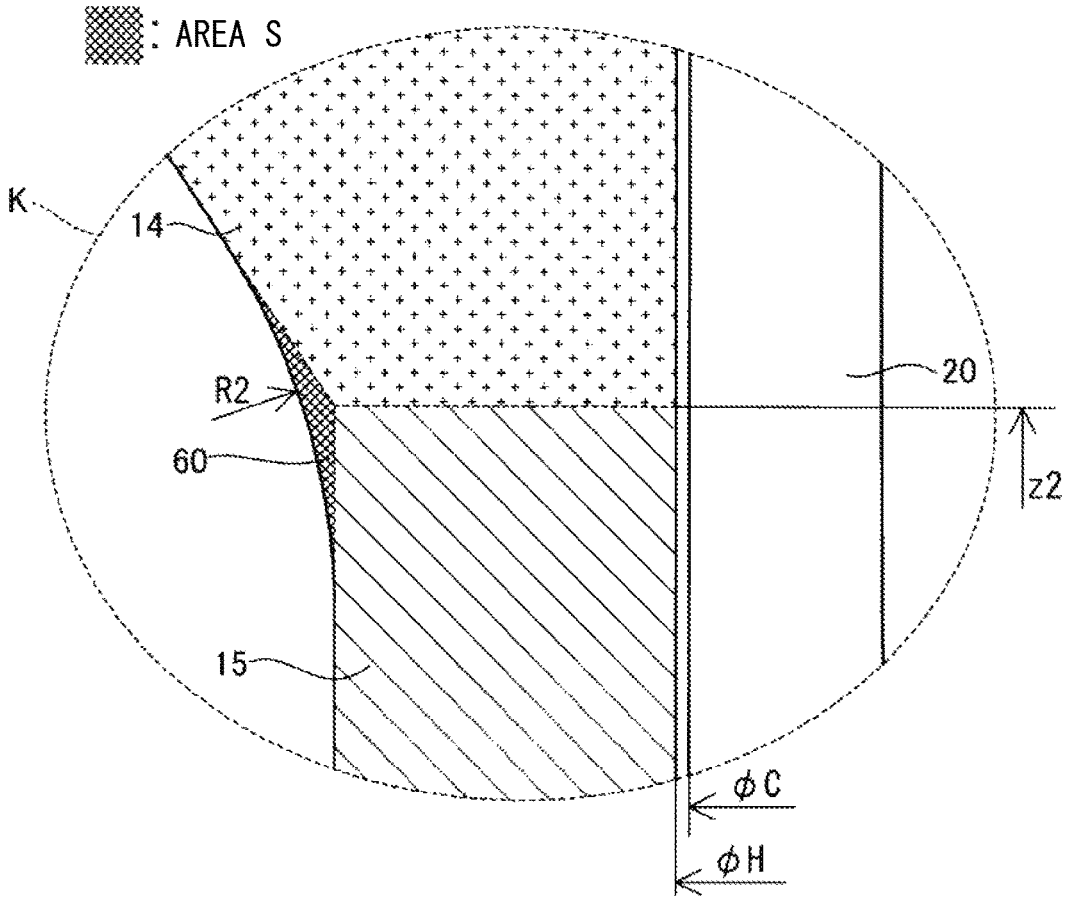
FIG. 3 is an enlarged view of range K.

FIG. 3 is an enlarged view of range K shown in FIG. 2. As shown in FIG. 3, the ceramic insulator 10 includes a padded part 60. In the present embodiment, the padded part 60 is regarded as a separate part from the truncated cone-shaped portion 14 and the second cylindrical portion 15. In a cross section including the axis line O, the padded part 60 is a part surrounded by a straight line at the front end side of the truncated cone-shaped portion 14, a straight line extended from the second cylindrical portion 15, and an outer diameter line of the ceramic insulator 10. In the present embodiment, the padded part 60 has a rounded shape (cross section having a circular arc shape). The padded part 60 is integrally formed with the truncated cone-shaped portion 14 and the second cylindrical portion 15.

As shown in FIG. 3, the boundary between the truncated cone-shaped portion 14 and the second cylindrical portion 15 is determined by a line segment that perpendicularly intersects the axis line O and passes through an intersection point between the straight line at the front end side of the truncated cone-shaped portion 14 and the straight line extended from the second cylindrical portion 15.

In the following, the dimensions shown in FIG. 2 will be described. ØC is an outer diameter of the center electrode 20 on the front end side of the center electrode flange portion 25 (FIG. 1). As shown in FIG. 2, the center electrode 20 in the present embodiment has, at a part opposing the second cylindrical portion 15, a tapered shape in which the diameter decreases toward the front end. ØC refers to an outer diameter on the rear end side of this tapered shape. This tapered shape and the front end side of the tapered shape are formed in order to combust, by a minute electric discharge between the ceramic insulator 10 and the center electrode 20, and remove carbon or the like deposited around the front end of the ceramic insulator 10.

The outer diameter of the front end side of the tapered shape is ØCt as shown in FIG. 2. The position of the boundary between ØCt and the tapered shape in the axis line direction OD is preferably identical to that of the front end surface of the ceramic insulator 10 or within a range up to 3 mm from the front end surface of the ceramic insulator 10 toward the rear end side. Thus, a length w shown in FIG. 2 is preferably 0 mm or larger but not larger than 3 mm. In the following, unless mentioned otherwise in particular, "position" refers to a position in the axis line direction OD.

ØH is an inner diameter of the ceramic insulator 10 and is preferably not smaller than 1 mm but not larger than 3 mm. The above described ØC is preferably not smaller than (ØH−0.2 mm) but not larger than (ØH−0.03 mm). ØZ1 is an outer diameter of the first cylindrical portion 13. ØZ2 is an outer diameter of the second cylindrical portion 15. When the nominal diameter of the thread portion 52 is M14, ØZ1 is preferably not smaller than 6 mm but not larger than 8 mm, and ØZ2 is preferably not smaller than 3 mm but not larger than 6 mm. When the nominal diameter of the thread portion 52 is M12, ØZ1 is preferably not smaller than 5 mm but not larger than 7 mm, and ØZ2 is preferably not smaller than 3 mm but not larger than 5 mm. When the nominal diameter of the thread portion 52 is M10, ØZ1 is preferably not smaller than 4 mm but not larger than 6 mm, and ØZ2 is preferably not smaller than 3 mm but not larger than 4 mm.

A length L is the length from the rear end of the first cylindrical portion 13 to the front end of the second cylindrical portion 15 in the axis line direction OD, and is preferably not smaller than 3 mm but not larger than 20 mm. In the following, unless mentioned otherwise in particular, "length" refers to the length in the axis line direction OD. A length z1 is the length of the first cylindrical portion 13 and is preferably not smaller than 1 mm but not larger than 4 mm. A length z2 is the length of the second cylindrical portion 15 and is preferably not smaller than 1.5 mm but not larger than 9 mm. The length of the truncated cone-shaped portion 14 is length L−length z1−length z2.

Figures 7, 8, 9:
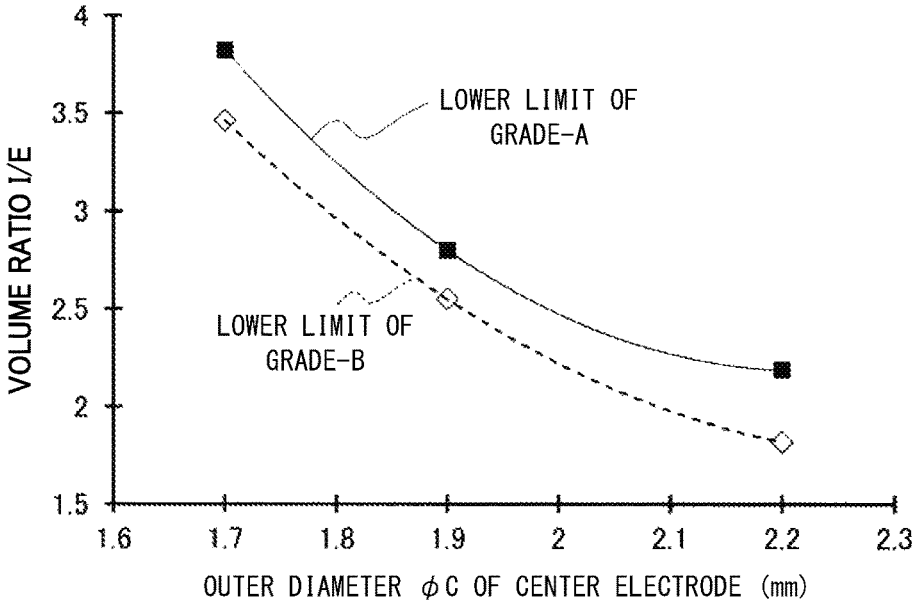
FIG. 7 is a graph regarding the evaluation test of the center electrodes.
FIG. 8 is a table showing test results of anti-fouling characteristic.
FIG. 9 is a table showing test results of breakage resistance.

A length g is the length from the rear end of the second cylindrical portion 15 to the front end surface of the metal shell 50. The length g is preferably 0 mm or larger but not larger than 6 mm. Further preferable values will be described later (FIG. 8).

Having the front end position of the core material 22 located within a predetermined range is preferable for dissipating heat of the center electrode 20. The predetermined range is a range of up to 2 mm toward the front end side and of up to 2 mm toward the rear end side, based on the front end position of the ceramic insulator 10. As shown in FIG. 2, since the front end position of the core material 22 in the present embodiment is the same as the front end position of the ceramic insulator 10, the front end position of the core material 22 is within the predetermined range.

In the following, multiple types of evaluation tests conducted on samples of the spark plug 100 will be described. For each of the evaluation tests, multiple samples with varying dimensions on which focus is placed in each of the evaluation tests were prepared.

An evaluation test of oxidation resistance of the center electrode 20 will be described as one of the multiple evaluation tests. The dimensions varied in this evaluation test are ØC, ØH, ØZ1, ØZ2, length L, length z1, and length z2.

FIGS. 4, 5, and 6 show tables of the results of the above described evaluation test conducted on the center electrode 20. FIGS. 4, 5, and 6 respectively show cases of ØC=1.7 mm, ØC=1.9 mm, and ØC=2.2 mm. It should be noted that since ØH is a value obtained by adding 0.06 mm to ØC in all samples, diagrammatic representation thereof in FIGS. 4, 5, and 6 is omitted.

The dimensions described together with FIG. 2 are values measured in the test. On the other hand, a ceramic insulator volume I, a center electrode volume E, and a volume ratio I/E shown in FIGS. 4, 5, and 6 are calculated values based on these measured values. The ceramic insulator volume I is a total of the volume of the truncated cone-shaped portion 14 and the volume of the second cylindrical portion 15. The volume of the truncated cone-shaped portion 14 is calculated by subtracting the volume of the hollow portion from the volume of the truncated cone forming the outline of the truncated cone-shaped portion 14. The volume of the second cylindrical portion 15 is calculated by subtracting the volume of the hollow portion from the volume of the cylindrical forming the outline of the second cylindrical portion 15, and then taking into account decrement of volume by R1.

The center electrode volume E is the volume of the center electrode 20 from the rear end position of the truncated cone-shaped portion 14 to the front end position of the second cylindrical portion 15. The center electrode volume E is calculated by taking into account decrement of volume resulting from reduction in diameter of the center electrode 20.

The volume ratio I/E is a value obtained by dividing the ceramic insulator volume I by the center electrode volume E. FIGS. 4, 5, and 6 are shown in a descending order sorted by the volume ratio I/E.

As described above, the nominal diameter of the thread portion 52 in the present embodiment is M14. However, the results shown in FIGS. 4, 5, and 6 also contain results of samples with M10 and M12 from other embodiments.

The procedure of the test will be described. In atmospheric environment, with respect to the spark plug 100 attached to a water-cooled chamber, heating for 2 minutes and cooling for 1 minute were alternately conducted for 3000 times. The heating was conducted by using a burner and at a condition in which the front end surface of the ceramic insulator 10 becomes 950° C. after 2 minutes from the start of the heating. A radiation thermometer was used to examine the temperature. The cooling was conducted through natural cooling after the burner was turned off. After the test had ended, the spark plug 100 was disassembled for observing the center electrode 20 at the cross section including the axis line O and measuring the thickness of an oxidatively altered layer on the front end surface of the electrode tip 29. This thickness is zero mm before the test.

Samples were evaluated as grade-A, grade-B, or grade-X when the thickness of the oxidatively altered layer was smaller than 0.1 mm, not smaller than 0.1 mm but smaller than 0.2 mm, or not smaller than 0.2 mm, respectively. Grade-B is more preferable than grade-X, and grade-A is more preferable than grade-B.

As shown in FIG. 4, when ØC=1.7 mm, an evaluation of grade-A is obtained if the volume ratio I/E is not lower than 3.82 (sample Nos. 1-11). As shown in FIG. 5, when ØC=1.9 mm, an evaluation of grade-A is obtained if the volume ratio I/E is not lower than 2.80 (sample Nos. 15-27). As shown in FIG. 6, when ØC=2.2 mm, an evaluation of grade-A is obtained if the volume ratio I/E is not lower than 2.19 (sample Nos. 30-39). Thus, these values are preferable.

As shown in FIG. 4, when ØC=1.7 mm, an evaluation of grade-B or better is obtained if the volume ratio I/E is not lower than 3.46 (sample Nos. 1-13). As shown in FIG. 5, when ØC=1.9 mm, an evaluation of grade-B or better is obtained if the volume ratio I/E is not lower than 2.55 (sample Nos. 15-28). As shown in FIG. 6, when ØC=2.2 mm, an evaluation of grade-B or better is obtained if the volume ratio I/E is not lower than 1.82 (sample Nos. 30-42). Thus, these values are preferable.

By using the above described preferable values, since oxidation of the center electrode 20 is suppressed even when ØC is set to be not larger than 2.2 mm, a design capable of simultaneously achieving improvement in voltage resistance, suppression of side sparking, and suppression of oxidation of the center electrode 20 becomes possible.

FIG. 7 is a graph in which the above described test results are plotted. The vertical axis represents the volume ratio I/E, and the horizontal axis represents the outer diameter ØC of the center electrode 20. In FIG. 7, two approximate curves are shown.

The curve drawn with a solid line was obtained by fitting, to a quadratic function, three sets of vales (ØC, I/E)=(1.7, 3.82), (1.9, 2.80), (2.2, 2.19) defining the lower limit for obtaining grade-A. The approximation formula of this curve is $I/E=6.1333ØC^2-27.18ØC+32.301$. Even when ØC is other than 1.7 mm, 1.9 mm, or 2.2 mm; grade-A is inferred to be obtained if the following inequality (1) is satisfied.

$$I/E \geq 6.1333ØC^2-27.18ØC+32.301 \quad (1)$$

It should be noted that spreadsheet software Excel (registered trademark) was used for the fitting and deriving of the approximation formula described above, and for the fitting and deriving of approximation formulae described later.

The curve drawn with a dashed line was obtained by fitting, to a quadratic function, three sets of values (ØC, I/E)=(1.7, 3.46), (1.9, 2.55), (2.2, 1.82) defining the lower limit for obtaining grade-B or better. The approximation formula of this curve is $I/E=4.2333ØC^2-19.79ØC+24.869$. Even when ØC is other than 1.7 mm, 1.9 mm, or 2.2 mm; grade-B or better is inferred to be obtained if the following inequality (2) is satisfied.

$$I/E \geq 4.2333ØC^2-19.79ØC+24.869 \quad (2)$$

FIG. 8 shows a table of the test results regarding anti-fouling characteristic. In this test, focus was placed on the length g shown in FIG. 2. In the present embodiment, the length from the front end of the second cylindrical portion 15 to the front end surface of the metal shell 50 is fixed to 1.5 mm. Thus, the length g in the present embodiment is length z2−1.5 mm. In addition, the length from the front end of the second cylindrical portion 15 to the front end of the center electrode 20 is also fixed to 1.5 mm.

The procedure of the test will be described. An automobile with a 4-cylinder DOHC engine having a displacement of 1.6 L was prepared on a chassis dynamometer placed within a low-temperature laboratory set at −10° C. The spark plug 100 was attached to the engine of this automobile as a sample.

Then, a later described first running pattern, natural cooling by stopping the engine, and a later described second running pattern were sequentially conducted as a single cycle, and insulation resistance of the spark plug 100 at each cycle was measured.

The test was ended when the insulation resistance decreased to 10 MΩ or lower. Samples were evaluated as grade-X, grade-B, or grade-A, when the number of cycles at the end of the test was not more than 5 cycles, 6 to 19 cycles, or not less than 20 cycles, respectively.

The first running pattern is revving up the engine for three times, running at a speed of 35 km/h in third gear for 40 seconds, 90 seconds of idling, and running at 35 km/h in third gear again for 40 seconds.

The second running pattern is revving up the engine for three times, and then repeating running and stopping of the engine. This manner of running was repeated three times. A single session of the running was conducted at 15 km/h in first gear for 20 seconds. The stopping of the engine was conducted for 30 seconds. After the second running pattern, the engine was stopped and then the first running pattern for the next cycle was conducted.

As shown in FIG. 8, grade-A was obtained when the length g was not smaller than 1.5 mm. Thus, the length g is preferably not smaller than 1.5 mm. Fouling of the ceramic insulator 10 associated with combustion within the combustion chamber is the main reason for the decrease in insulation resistance as the number of cycles increases. The fouling induces side sparking. Side sparking can be suppressed by improving anti-fouling characteristic based on preferable dimensions. The reason why fouling is suppressed when the length g is large is because the truncated cone-shaped portion 14 whose outer diameter is larger than that of the second cylindrical portion 15 is distanced away from the front end surface of the metal shell 50.

FIG. 9 shows a table of the test results regarding breakage resistance of the ceramic insulator 10. In this test, focus was placed on the length z2 and an area S. As shown in FIG. 3, the area S is a cross-sectional area of one side of the padded part 60. The value of the area S shown in FIG. 9 is a value calculated from the value of R2 and the shape of the truncated cone-shaped portion 14. The value of R2 is the value of radius of curvature.

The procedure of the evaluation test will be described. In atmospheric environment, the spark plug 100 attached to a water-cooled chamber was heated for 2 minutes, and a load was applied on the ceramic insulator 10. The heating was conducted by using a burner and at a condition in which the front end surface of the ceramic insulator 10 becomes 750° C. after 2 minutes from the start of the heating. The magnitude of the applied load was 850 N. The point where the load was applied was the frontmost end portion of the ceramic insulator 10, and the direction of the load was orthogonal to the axis line O. The load was applied within 15 seconds after the burner was turned off. The reason why the load was applied within 15 seconds is in order to conduct the test under a stricter condition. Since the mechanical strength of the ceramic insulator 10 deteriorates when the temperature is high, applying the load immediately after the heating is a strict condition for breakage resistance.

Ten spark plugs were tested for each sample, and the number of samples with breakage was counted. Samples were evaluated as grade-B, or grade-A, when the number of spark plugs with breakage was, out of the ten plugs, more than one, or none, respectively.

As shown in FIG. 9, in cases where the length z2 is 2 mm and 3 mm, grade-A was obtained even when the area S was zero. On the other hand, in cases where the length z2 is 4 mm, grade-A was obtained when the area S was not smaller than 0.02 $mm^2$ (sample Nos. 50, 51). Thus, in cases where the length z2 is not smaller than 4 mm, the area S is preferably not smaller than 0.02 $mm^2$.

Improving breakage resistance in such a manner is particularly preferable for usage in a high compression ratio engine. Engines of natural air intake and having a compression ratio of not lower than 11 or engines with a supercharger and having a compression ratio of not lower than 9.5 are known to cause abnormal combustion within a specific operating range and generate very large pressure waves. When this phenomenon occurs, shock is applied to the front end portion of the ceramic insulator 10 to cause breakage in some cases. The breakage easily occurs at the boundary between the truncated cone-shaped portion 14 and the second cylindrical portion 15 where stress is concentrated. Breakage was confirmed to be suppressed when this boundary was reinforced with the padded part 60, even when the length z2 was as large as 4 mm.

In the samples used in the tests described together with FIGS. 8 and 9, the nominal diameter, ØZ1, the length z1, the length L, and Øz2 of the thread portion 52 were respectively set as M14, 6.9 mm, 2.8 mm, 12 mm, and 3.7 mm.

FIG. 10 shows a table of the test results regarding insulation characteristic. In this test, focus was placed on the type of engine, presence or absence of the first cylindrical portion 13, and a direction t. As shown in FIG. 2, the direction t is a direction from the front end position of an opposing surface 57*a* to the front end position of the first cylindrical portion 13. A direction from the rear end to the front end is defined as positive and the opposite direction is defined as negative. FIG. 2 shows a case where the direction t is positive. The opposing surface 57*a* is one part of the shelf portion 57, and is a surface that is parallel to the axis line O and that opposes the ceramic insulator 10.

For reference, FIG. 10 comprehensively shows the presence or absence of the second cylindrical portion 15, ØZ2, and ØC. When the second cylindrical portion 15 is absent, the outer diameter of the front end of the ceramic insulator 10 was measured as ØZ2. In all the samples, ØZ1 was set as 6.9 mm.

The above described type of engine relates to the air intake method and the compression ratio. The air intake method is either natural air intake (NA) or with supercharger (S). It should be noted that a direct injection type engine was used for all the cases in the present test.

The procedure of the test will be described. Four of the spark plugs 100 of each sample were attached to an engine. The engine was rotated at a constant rotational speed (specifically, 5000 rpm), and, after 500 hours, samples were evaluated as grade-X, or grade-A, when the number of spark plugs that had been penetrated was, out of the four spark plugs, more than one, or none, respectively. Here, penetration refers to a through-hole formed in the ceramic insulator 10 disposed between the center electrode 20 and the shelf portion 57, as a result of voltage applied on the spark plugs 100 to cause breakage of the ceramic insulator 10.

As shown in FIG. 10, in cases where the first cylindrical portion 13 is present and the direction t is positive; grade-A was obtained even with natural air intake and a compression ratio of 11. Furthermore, in cases where the first cylindrical portion 13 is present and the direction t is positive; grade-A was obtained even with supercharger and a compression ratio of 9.5. Thus, the first cylindrical portion 13 is preferably present and the direction t is preferably positive in cases with natural air intake and a compression ratio of not lower than 11 or in cases with supercharger and a compression ratio of not lower than 9.5.

The reason why insulation characteristic is improved by the above described preferable condition is because certain thickness of the ceramic insulator 10 is ensured around the shelf portion 57. Since the shelf portion 57 is a part whose distance from the center electrode 20 is small, penetration occurs easily at the shelf portion 57. Setting the direction t as positive to avoid the truncated cone-shaped portion 14, where the ceramic insulator 10 becomes thin, from opposing the opposing surface 57*a* was confirmed to suppress penetration.

The present invention is not limited to the embodiments, examples, and modified embodiments described above, and can be embodied in various configurations without departing from the gist of the present invention. For example, the technical features in the embodiments, examples, and modified embodiments corresponding to the technical features in each mode described in the Summary of the Invention section can be appropriately replaced or combined to solve some of or all of the foregoing problems, or to achieve some of or all of the foregoing effects. Further, such technical features may be appropriately deleted if not described as being essential in the present specification.

Figure 11:
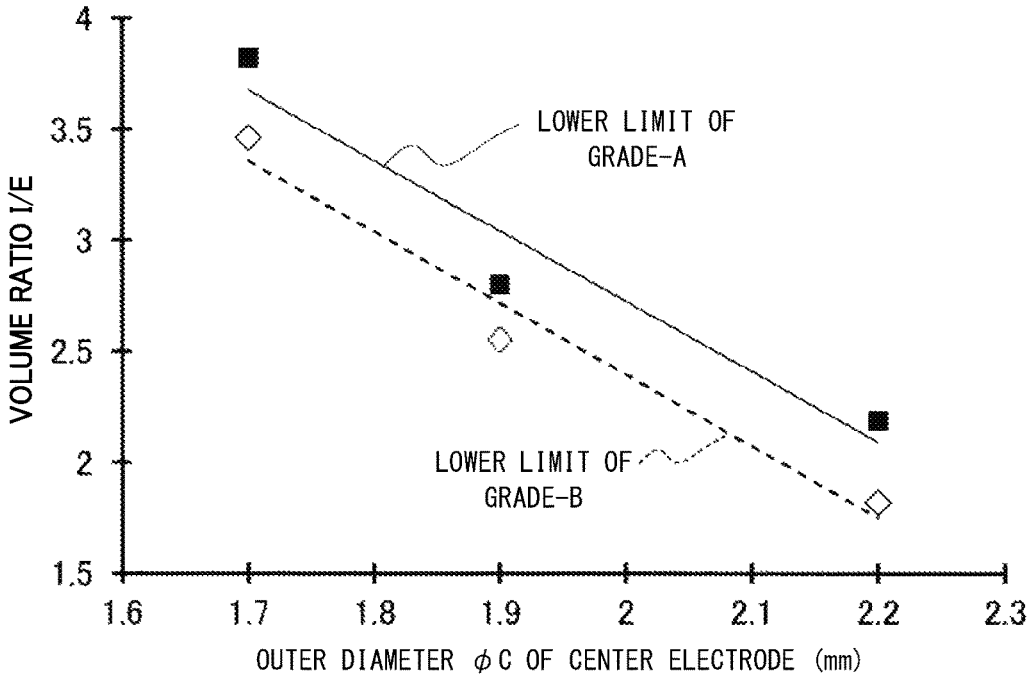
FIG. 11 is a graph regarding evaluation test of center electrodes.

Similarly to FIG. 7, FIG. 11 is a graph in which lower limit values of the volume ratio I/E for obtaining a preferable result are plotted against the outer diameter ØC of the center electrode. In FIG. 11, two approximate straight lines are shown.

The straight line drawn with a solid line was obtained by fitting, to a linear function, three sets of values defining the lower limit for obtaining grade-A. The approximation formula of this straight line is I/E=−3.1632ØC+9.0521. Even when ØC is other than 1.7 mm, 1.9 mm, or 2.2 mm; grade-A is inferred to be obtained if the following inequality (3) is satisfied.

$$I/E \geq -3.1632ØC+9.0521 \quad (3)$$

The straight line drawn with a dashed line was obtained by fitting, to a linear function, three sets of values defining the lower limit for obtaining grade-B or better. The approximation formula of this straight line is I/E=−3.2132ØC+8.8221. Even when ØC is other than 1.7 mm, 1.9 mm, or 2.2 mm; grade-B or better is inferred to be obtained if the following inequality (4) is satisfied.

$$I/E \geq -3.2132ØC+8.8221 \quad (4)$$

Figure 12:
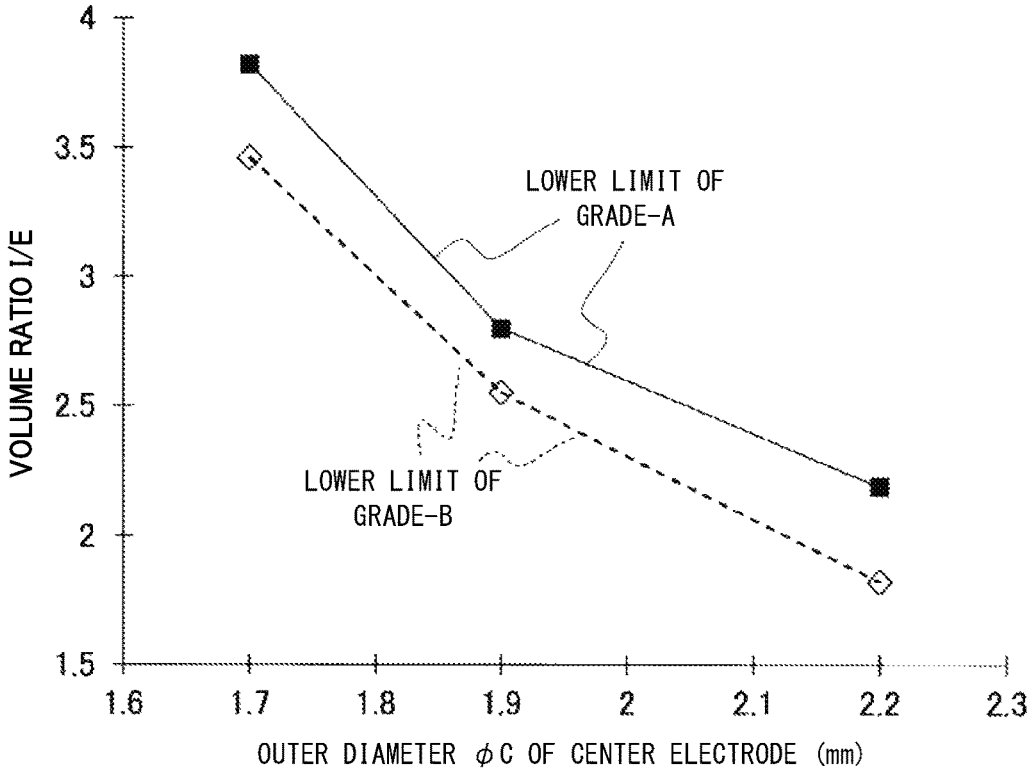
FIG. 12 is a graph regarding evaluation test of center electrodes.

Similarly to FIG. 7, FIG. 12 is a graph in which lower limit values of the volume ratio I/E for obtaining a preferable result are plotted against the outer diameter ØC of the center electrode. In FIG. 11, four approximate straight lines are shown.

The straight lines drawn with solid lines were obtained by fitting three sets of values defining the lower limit for obtaining grade-A to linear functions separately for ØC≤1.9 mm and 1.9 mm≤ØC. The approximation formulae of the straight lines are I/E=−5.10ØC+12.49 (ØC≤1.9 mm) and I/E=−2.0333ØC+6.6633 (1.9 mm≤ØC). Even when ØC is other than 1.7 mm, 1.9 mm, or 2.2 mm; grade-A is inferred to be obtained if the following inequality (5) is satisfied.

$$I/E \geq -5.1ØC+12.49(ØC \leq 1.9\text{ mm});I/E \geq -2.0333ØC+6.6633(1.9\text{ mm} \leq ØC) \quad (5)$$

The straight lines drawn with dashed lines were obtained by fitting three sets of values defining the lower limit for obtaining grade-B or better to linear functions, separately for ØC≤1.9 mm and 1.9 mm≤ØC. The approximation formulae of the straight lines are I/E=−4.55ØC+11.195 (ØC≤1.9 mm) and I/E=−2.4333ØC+7.1733 (1.9 mm≤ØC). Even when ØC is other than 1.7 mm, 1.9 mm, or 2.2 mm; grade-B or better is inferred to be obtained if the following inequality (6) is satisfied.

$$I/E \geq -4.55ØC+11.195(ØC \leq 1.9\text{ mm});I/E \geq -2.4333ØC+7.1733(1.9\text{ mm} \leq ØC) \quad (6)$$

The above described truncated cone-shaped portion has a cross-sectional shape of a trapezoid, and the legs of the trapezoid are linear. However, the shape of the truncated cone-shaped portion is not limited thereto. For example, the shape of the parts corresponding to the legs of the trapezoid may be bent or curved. When the bent shape is used, the padded part may be defined with a straight line on the front end side.

The outer diameter of the center electrode may be smaller than 1.7 mm.

When the outer diameter of the center electrode is smaller than 1.7 mm, at least one of the above described inequalities (1) to (6) may be satisfied.

The fitting described above may be conducted to a function other than a linear function or a quadratic function. For example, functions with an order higher than second order, exponential functions, and logarithmic function, etc., may be used.

The spark plug described as the embodiment may be used in a port spray type gasoline engine. The nominal diameter of the thread portion is not limited to those described above, and, for example, any one of M6, M8, M10, M12, M14, M16, M18, M20, M22, or M24 may be used.

The cross-sectional shape of the padded part may be other than the rounded shape, such as, for example, a linear shape.

An electrode tip may be disposed on the ground electrode.

DESCRIPTION OF REFERENCE NUMERALS

3: ceramic resistor
4: seal body
5: gasket
6: ring member
8: plate packing
9: talc
10: ceramic insulator
12: axial hole
13: first cylindrical portion
14: truncated cone-shaped portion
15: second cylindrical portion
16: outer circumference-side step portion
17: front end-side trunk portion
18: rear end-side trunk portion
19: flange
20: center electrode
21: electrode base material
22: core material
25: center electrode flange portion
29: electrode tip
30: ground electrode
33: front end portion
40: metal terminal
50: metal shell
51: tool engagement portion
52: thread portion
53: crimp portion
54: flange
55: seating surface
57: shelf portion
57*a*: opposing surface
58: buckling portion
59: thread root
60: padded part
100: spark plug
200: engine head
201: attachment thread hole
205: opening peripheral portion

The invention claimed is:

1. A spark plug comprising:

an insulator having an axial hole that extends along an axis line;

a center electrode inserted within the axial hole;

a metal shell disposed at an outer circumference of the insulator and having an inner circumference on which is formed a shelf portion that bulges radially inward; and a ground electrode disposed at a front end surface of the metal shell, wherein the insulator includes:

a first cylindrical portion that opposes at least a part of the shelf portion;

a truncated cone-shaped portion having a rear end that is formed at a front end side of the first cylindrical portion and an outer diameter that reduces from the rear end to a front end side of the truncated cone-shaped portion; and a second cylindrical portion formed at the front end side of the truncated cone-shaped portion, a diameter C of the center electrode at a portion of the center electrode that opposes the shelf portion in a direction along the axis line is not larger than 2.2 mm, and a total I of a volume of the truncated cone-shaped portion and a volume of the second cylindrical portion, a volume E of the center electrode from the rear end of the truncated cone-shaped portion to a front end of the second cylindrical portion with respect to the direction along the axis line, and the diameter C satisfy the following formula:

$$I/E \geq 4.2333C^2 - 19.79C + 24.869.$$

2. A spark plug according to claim 1, wherein the total I, the volume E, and the diameter C satisfy the following formula:

$$I/E \geq 6.1333C^2 - 27.18C + 32.301.$$

3. A spark plug according to claim 1, wherein with respect to the direction along the axis line, the front end side of the first cylindrical portion is nearer to the front end of the second cylindrical portion than a front end of a surface of the shelf portion opposing the first cylindrical portion.

4. A spark plug according to claim 1, wherein with respect to the direction along the axis line, a distance from a rear end of the second cylindrical portion to a front end surface of the metal shell is greater than or equal to 1.5 mm.

5. A spark plug according to claim 1, wherein a length of the second cylindrical portion in the direction along the axis line is not smaller than 4 mm, and an area, in a cross section including the axis line, of one side of a padded part surrounded by a straight line at a front end side of the truncated cone-shaped portion, a straight line extended from the second cylindrical portion, and an outer diameter line of the insulator, is not smaller than 0.02 $mm^2$.

6. A spark plug according to claim 1, wherein an external thread is formed on an outer circumference of the metal shell, and a nominal diameter of the external thread is M14.

7. A spark plug according to claim 1, wherein the spark plug is used in at least one of an engine with a supercharger and having a compression ratio of not lower than 9.5, or a natural air intake engine having a compression ratio of not lower than 11.

* * * * *